US007086443B2

(12) United States Patent
Williams

(10) Patent No.: US 7,086,443 B2
(45) Date of Patent: Aug. 8, 2006

(54) HIGH WIND CABLE SUPPORT SYSTEMS

(75) Inventor: Gerald H. Williams, West Branch, MI (US)

(73) Assignee: Napoleon Spring Works, Inc., Archbold, OH (US)

( * ) Notice: Subject to any disclaimer, the term of this patent is extended or adjusted under 35 U.S.C. 154(b) by 0 days.

(21) Appl. No.: 10/826,036

(22) Filed: Apr. 16, 2004

(65) Prior Publication Data

US 2005/0230062 A1 Oct. 20, 2005

(51) Int. Cl.
*E06D 15/16* (2006.01)

(52) U.S. Cl. ..... 160/209

(58) Field of Classification Search ..... 160/209, 160/201, 181, 207, 233, 234
See application file for complete search history.

(56) References Cited

U.S. PATENT DOCUMENTS 3,424,223 A * 1/1969 Rosenblatt ..... 160/209
3,443,625 A * 5/1969 Moser et al. ..... 160/181
3,516,474 A * 6/1970 Loose et al. ..... 160/209
5,046,544 A * 9/1991 Coluccio ..... 160/201
5,383,509 A * 1/1995 Gaffney et al. ..... 160/209
5,445,207 A * 8/1995 Romanelli et al. ..... 160/209
5,819,834 A * 10/1998 Wedekind ..... 160/209
5,964,269 A * 10/1999 Decola ..... 160/209
6,161,606 A 12/2000 Wegner et al.
6,385,916 B1 * 5/2002 Marko ..... 52/127.2
6,408,926 B1 6/2002 Hoofard et al.
6,463,988 B1 10/2002 Mullet et al.
6,776,210 B1 * 8/2004 Wells ..... 160/209

* cited by examiner

*Primary Examiner*—David Purol

(74) *Attorney, Agent, or Firm*—McDonnell Boehnen Hulbert & Berghoff LLP

(57) ABSTRACT

Cable system for use with an overhead door comprising: a header bracket; a floor assembly; at least one cable having a first end attached to the header bracket and a second end attached to the floor assembly.

27 Claims, 7 Drawing Sheets

HIGH WIND CABLE SUPPORT SYSTEMS

BACKGROUND OF THE INVENTION (1) Field of the Invention

This invention concerns cable systems useful for improving the windload resistance of overhead doors.

(2) Description of the Art

Overhead doors are widely employed as garage closures because they achieve the desired result with minimal loss of floor space. It is desired to construct such doors from relatively lightweight materials such as fiberglass and sheet metal panels to reduce the difficulty involved in raising and lowering the door. However, even relatively light weight doors can weigh in excess of three hundred pounds.

A particular problem with large area doors arises in geographic areas such as so-called "hurricane zones" which are subject to high wind conditions. The wind load on a double width garage door can cause the door to flex inwardly with positive pressure and outwardly with negative pressure at the center and sufficient flexing can cause buckling, permanent deformation and, at the extreme, catastrophic failure.

Various methods have been proposed to address the need for reinforcement in sectional garage and warehouse doors. Some of the methods must be manually engaged to protect overhead doors during high wind events. A manually engaged apparatuses is disclosed, for example, in U.S. Pat. No. 6,385,916 in which a vertical bar associated with the door header must be manually engaged with a floor aperture in order to support the door during high wind events. The problem with manual systems are that they require human intervention. The system will not work if it is not activated.

This problem has been partly solved by integrating stiffening devices into overhead door panels. U.S. Pat. No. 6,161,606 for example adds one or more reinforcing struts along the length of overhead door panels. Another method disclosed in U.S. Pat. No. 6,473,988 uses one or more flexible members to transfer wind imparted forces to the guide rollers. Lateral reinforcing beams are also used in U.S. Pat. No. 6,408,926 to give overhead doors additional wind resistance. These solutions are also less than ideal because they require door manufactures to either retrofit doors on site to add the appropriate strengthening feature or to supply and support several different garage door panel designs. There is a need, therefore, for a system that solves one or more of these problems with current wind resistant overhead door systems.

SUMMARY OF THE INVENTION

One aspect of this invention is a cable system for use with an overhead door comprising: a header bracket; a floor assembly; at least one cable having a first end attached to the header bracket and a second end attached to the floor assembly, wherein the cable is held in tension between the header bracket and floor assembly.

Another aspect of this invention is a cable system comprising: a header bracket; a floor assembly including a floor bracket having a hook and a floor plate including an aperture wherein the hook is engageable with the floor plate aperture; at least one intermediate cable support selected from a hinge including a first pin and a second pin wherein the first pin and second pin are offset and where the at least one cable passes between the first pin and the second pin, a strut including an aperture wherein the at least one cable passes through the strut aperture and combinations thereof; and at least one cable having a first end attached to the header bracket and a second end attached to the floor assembly, wherein the cable is held in tension between the header bracket and floor assembly.

Yet another aspect of this invention is an overhead door comprising at least one cable system of this invention wherein the overhead door includes a plurality of horizontal panels including a top panel, a bottom panel and at least one intermediate cable support associated with at least one panel, wherein the header bracket is attached to the top panel and the floor assembly includes a floor bracket attached to the bottom panel.

DESCRIPTION OF THE CURRENT EMBODIMENT

Figure 1A:
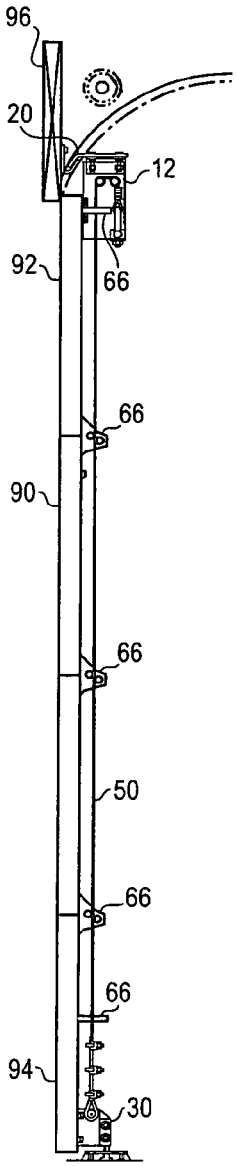
FIGS. 1A, 1B and 1C are side and close-up side and front views respectively of a cable system embodiment of this invention.

The present invention relates to cable systems that are associated with overhead doors such as commercial and residential garage doors in order to support and/or reinforce the overhead doors during high wind events such as hurricanes and wind storms. Preferred cable system embodiments of this invention will be described below with reference to residential garage doors. However, the cable systems of this invention may be used in conjunction with any moveable overhead door including, but not limited to residential, commercial, and industrial overhead doors.

The cable systems of this invention are designed to increase the windload resistance of overhead doors. Overhead doors such as garage door typically include a plurality of lateral panels. The plurality of panels are typically attached to one another with hinges, each hinge being attached to adjacent panels. Moreover, the panels may include struts to give the panels support. Most current garage doors include electronic garage door operators that shift the door between a closed position and an open position. More particularly, the operators exert a lifting force on the door as it is shifted to the open position, which will be with the door in a generally horizontal orientation due to the configuration of its guide tracks. Most residential garage door systems will have a vertical portion or run that guides the door to its closed position and a horizontal portion or run adjacent and below the ceiling of the garage so that the door is lifted open to a horizontal position. A curved or arcuate track portion interconnects the vertical and horizontal track runs. The door is closed by the operator exerting a closing force on the door.

Several embodiments of cable systems 10 of this invention are shown in FIGS. 1A–1B, 2A–2D, 3A–3B. Each of cable system embodiment 10 includes a header bracket 12, a floor assembly 30, and a cable 50. Moreover, each of the cable system embodiments, 10 further include additional optional features such as locking brackets 20, and intermediate cable supports 66.

The cable systems of this invention generally include a floor hook 36 which engages a floor plate 32 when a positive or negative pressure is applied against the face of the closed door to help keep the door from buckling. In addition, header bracket 12 includes an optional hook 14 that engages a complementary hook 22 associated with a locking bracket 20 that also engages when positive or negative pressure is applied against the face of the closed door to help keep the door from buckling. In one aspect of this invention, the cable system includes at least one locking mechanism selected from a floor hook 36 that engages a floor plate 32 or a hook 22 associated with a locking bracket 20 that engages a hook 14 associated with header bracket 12. In a preferred embodiment, the cable system of this invention will include both locking mechanisms.

The cable systems shown in FIGS. 1–3 et al. each include a header bracket 12. Header bracket 12 is attached to top panel 92 of a multi panel overhead door. Header bracket 12 may be reversibly or irreversibly attached to top panel 92 by means generally known to those or ordinary skill in the art. Bolts 16 are used in the cable system embodiments shown in the Figures to attached header bracket 12 to top panel 92.

Figure 4:
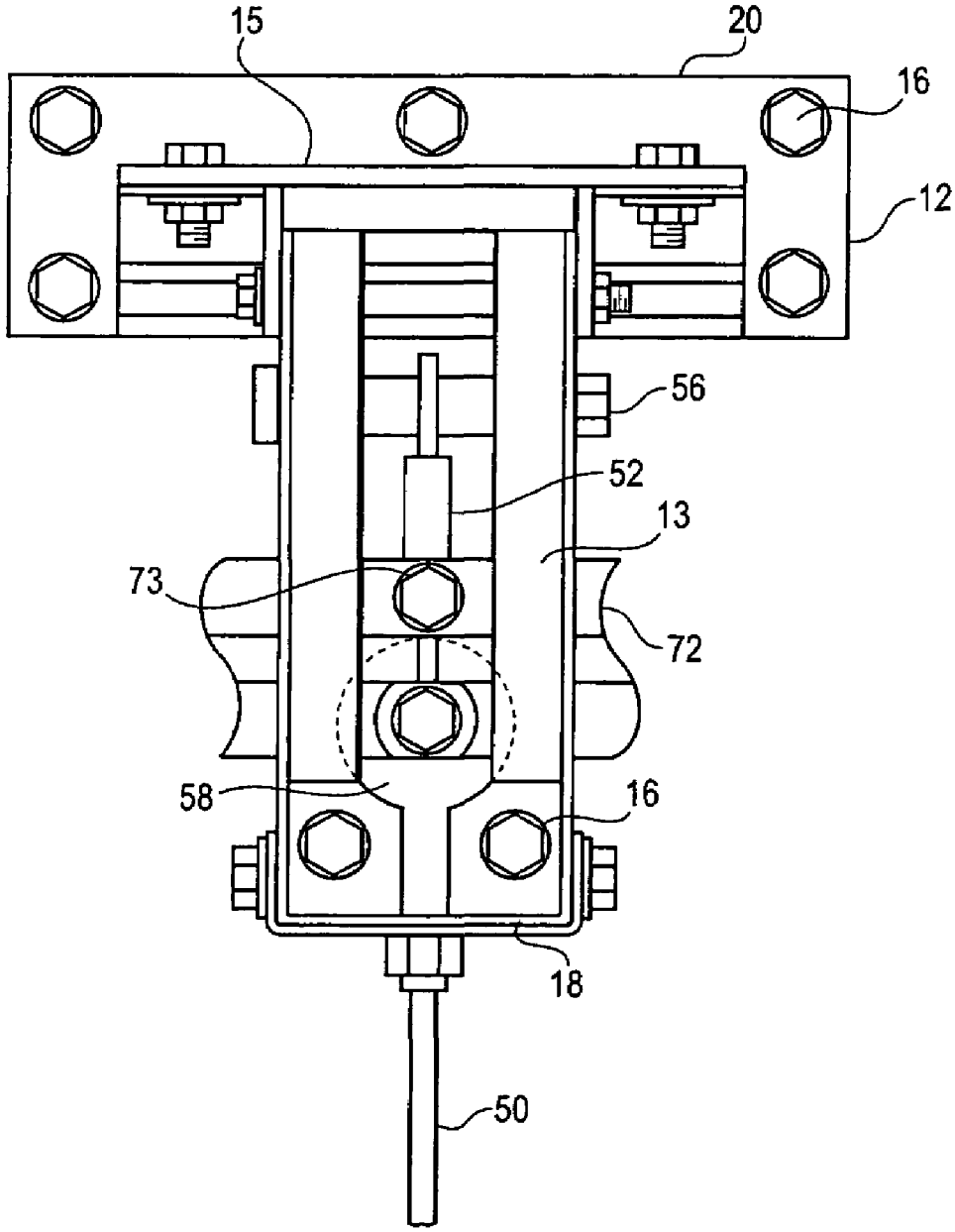
FIG. 4 is a front view of an embodiment of an upper bracket useful in the cable systems of this invention.

FIG. 4 is a front view of a header bracket 12 associated with a locking bracket 20. Header bracket 12 shown in FIG. 4 is the same header bracket 12 shown in FIGS. 1A–1C. Header bracket 12 includes a backplate 13 that is attached to top panel 92 of the overhead door. In the embodiment shown in FIG. 4, backplate 13 of header bracket 12 is associated with upper garage door upper top panel 92 after which a stiffener 72 is placed over backplate 13 of header bracket 12 and one or more bolts 16 are used to attach stiffener 72 and backplate 13 of header bracket 12 to top panel 92 such that backplate 13 is sandwiched between stiffener 72 and top panel 92. The embodiment of header bracket shown in FIG. 4 further includes a top 15 and two lateral sections 17 wherein lateral section 17 are parallel to one another and essentially perpendicular to top panel 92. Lateral sections 17 are united with top 15 bottom 18 of header bracket 12. Eye bolt 58 is associated with bottom 18 of header bracket 12. Moreover two clevis pins 56 are associated with lateral panels 17. As shown in FIG. 4; cable 50 passes through an aperture 73 and stiffener 72, passes over both clevis pins 56 and is attached to eye bolt 58. Moreover, a hook 14 may optionally be associated with top 15 of header bracket 12. In the embodiment shown in FIG. 4, hook 14 is bolted to top 15 of header bracket 12. However, hook 14 may be attached to header bracket 12 by any means known in the art including by an adhesive, by welding, by clamping and so forth.

Figure 6:
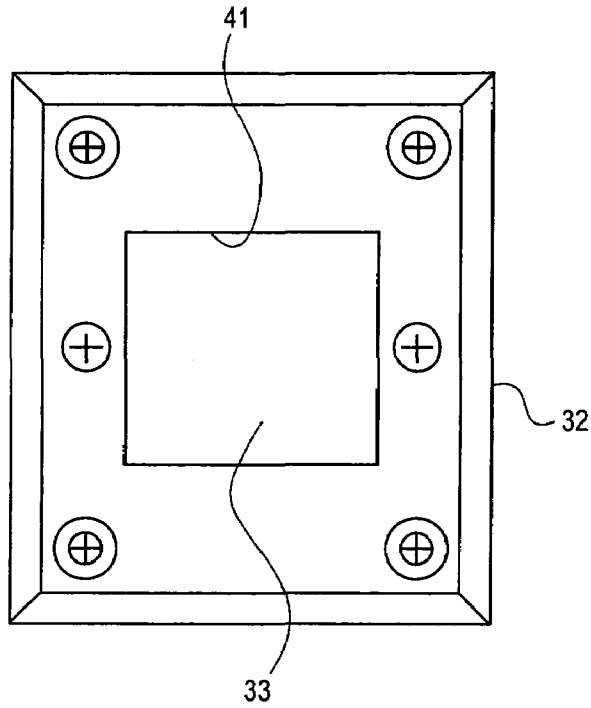
FIG. 6 is a top view of a floor plate useful in conjunction with cable systems of this invention.
Figure 8A:
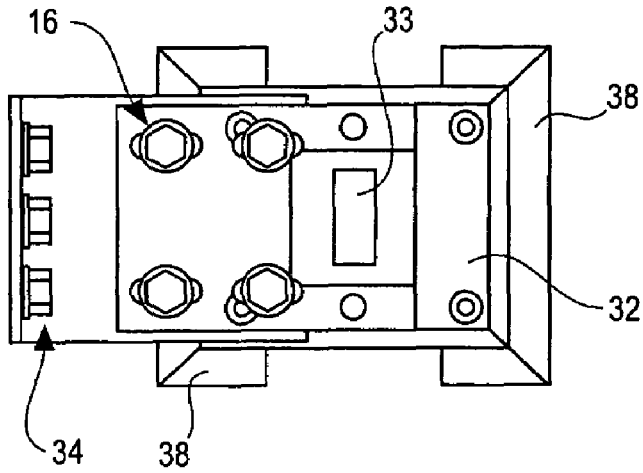
FIGS. 8A and 8B are top and front views respectively of a floor assembly embodiment useful with the cable systems of this invention.
Figure 8B:
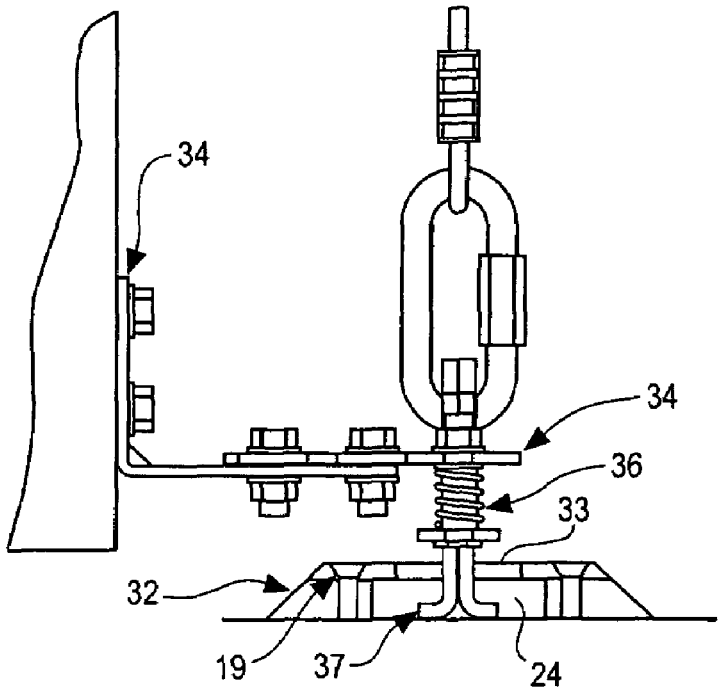

Cable system 10 further includes a floor assembly 30. An example of a floor assembly 30 is found in FIGS. 8A and 8B. Floor assembly 30 will typically include a floor bracket 34 attached to bottom panel 94 of an overhead door. As with header bracket 12, floor bracket 34 may be attached to bottom panel 94 of the overhead door using any reversible or non-reversible attaching devices known to those or ordinary skill in the art. In the embodiment shown in the Figures, a plurality of bolts 16 are used to attach floor bracket 34 to bottom panel 94. Floor assembly 30 further includes a floor plate 32. An example of a floor plate 32 is found in FIG. 6. Floor plate 32 further includes an aperture 33. Floor plate 32 may be attached directly to the floor or one or more spacers 38 may be located between floor plate 32 and the surface 39 of a floor. If floor plate 32 is attached directly to surface 39 of a floor, then surface 39 of the floor should include a lipped hole 40 that is complementary to aperture 33 of floor plate 32. Floor plate 32 in combination with spacers 38 or in combination with hole 40 in a floor will define a space 24 and end of floor assembly hook 36 will reside when the overhead door is closed. Space 24 may have lateral dimensions essentially identical to aperture 33 of floor plate 32. However, it is preferred that space 24 has a larger lateral dimension than aperture 33 of floor plate 32 so that foot 37 of hook 36 can engage the floor plate aperture in a dimension to thereby inhibit movement of bottom panel 94 during high wind events.

Figure 7A:
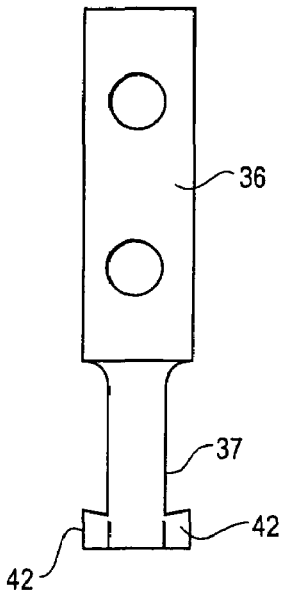
FIGS. 7A and 7B are side and front views respectively of a floor hook embodiment useful with cable systems of this invention.
Figure 7B:
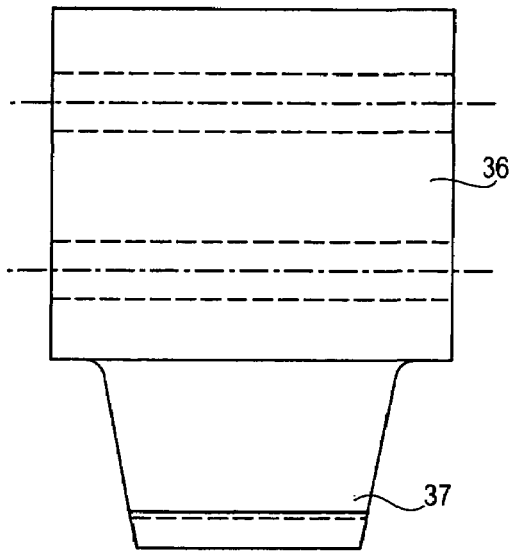

Floor assembly 30 further includes a hook 36 having a foot 37 as shown, for example in FIGS. 7A and 7B. When the overhead door is fully closed, foot 37 of foot 36 is located in aperture 33 of floor plate 32 such that any movement of the overhead door and specifically bottom panel 94 of overhead door causes foot 37 to collide with the edges 41 of aperture of floor plate aperture 33 thereby preventing gross movements of the overhead door during high wind events. Foot 37 may include one or more lateral feet 42. Lateral feet 24 will preferably lock against edges 41 of plate aperture 33 when bottom panel 94 moves laterally and when floor plate 32 is separated from floor surface 39 by a spacer 38. In an alternative embodiment, hole 40 in the floor surface 39 will include ledges for capturing lateral feet 42 of foot 37 when bottom panel 94 moves laterally in the wind.

The cable systems 10 further include one or more cables 50. Each cable has a first end 52 and a second end 54. Generally, cable first end 52 will be attached or associated with header bracket 12 while cable second end 54 will be attached or associated with floor plate 32 of floor assembly 30. First end 52 and second end 54 of cables 50 may be associated with the respective brackets by any means known in the art for attaching a cable to a bracket. Non-limiting examples of devices for attaching cable end to a bracket include clamps, welds, bolts, clips, sleeves, and plugs. In the Figures, cable ends 52 and 54 are looped ends that are attached to clevis pins 56 (e.g., FIGS. 2A, 2B and 3A–3B). Alternatively, the looped cable ends 52 and 54 may be attached to an eyebolt 58 as shown in FIG. 1A. Moreover, the cable end maybe associated with a threaded connector 59 as shown in FIGS. 2A and 2C. In FIGS. 1–3, the cable ends include optional cable clamps 60 and/or clips 62. Cable clamps 60 and clips 62 facilitate the formation of a loop at the ends of cable 50 and they allow for cable tensioning.

Cable 50 is preferably held in tension between header bracket 12 and floor assembly 30. The cable systems of this invention may include one or more than one cable that passes between header bracket 12 and floor assembly 30. Moreover, cable 50 may be a continuous or non-continuous cable. That is, cable 50 may include a continuous length of cable between first end 52 and second end 54. Alternatively, cable 50 may terminate somewhere between first end 52 and second end 54, for example, by attaching intermediate ends of cable 50 to horizontal panels 90 between top panel 92 and bottom panel 94 of the overhead door. A cable 50 that is non-continuous but that has an end 52 associated a header bracket 12 and an end 54 associated with floor assembly 30 will fall within the definition of a cable 50 of this invention having a first end 52 and a second end 54.

In an alterative embodiment of this invention, the first end 52 and second 54 of cable 50 may both be associated with either header bracket 12 or floor assembly 30. In this embodiment, an intermediate portion of the cable will loop around either header bracket 12 or floor assembly 30 to form a cable 50 including a plurality of lengths traveling between floor assembly 30 and header bracket 12. Once again, in this embodiment, cable 50 would be considered to have a first end associated with header bracket 12 and as a second end associated with floor assembly 30 such that cable 50 is held in tension between the two brackets. For ease of assembly and simplicity, it is preferred that the cable systems of this invention will include a single continuous cable having a first end 52 associated with header bracket 12 and a second end 54 associated with floor bracket 34.

The cables useful in cable systems 10 of this invention may be manufactured out of any material that is strong enough under tension to provide the necessary strengthening to overhead doors. The useful cable gauge will range from about 1/16" to about 5/16" or more. It is preferred that cable 50 is a woven steel cable having a gauge of about 3/16". Moreover, the cable may be uncoated or coated with a polymer to protect the cable from rust and damage.

The cable systems 10 of this invention further include optional intermediate cable supports 66. One purpose of intermediate cable supports 66 is to ensure that each overhead door panel 90 is associated with cable 50. Examples of intermediate cable supports include intermediate standoff brackets 68 shown for example in FIGS. 5A–5C, hinges 74 shown in FIGS. 1A–1B, struts 80 shown in FIGS. 1A–1B and vertical stand off brackets 70 shown in FIGS. 3A–3B. The cable system of this invention may include one or more intermediate cable supports 66. It is preferred, that each panel (90, 92, 94) includes at least one intermediate cable support 66 so that each panel 90, 92 and 94 are associated with cable 50.

Figure 5A:
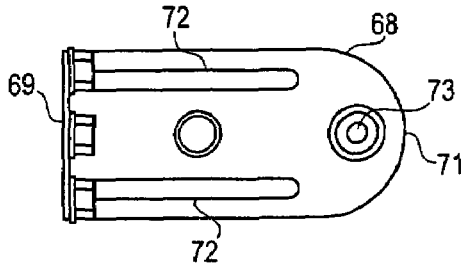
FIGS. 5A, 5B and 5C are top, side and front views respectively of a standoff bracket useful in conjunction with cable systems of this invention.
Figure 5B:
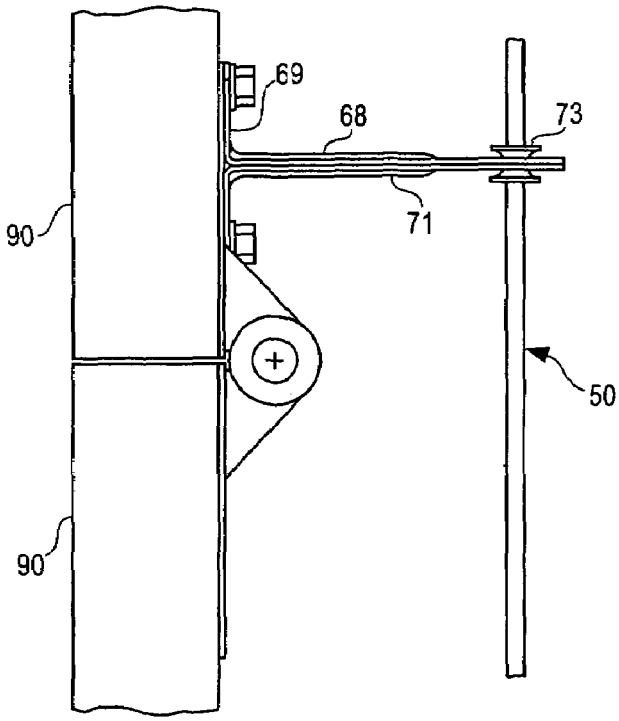
Figure 5C:
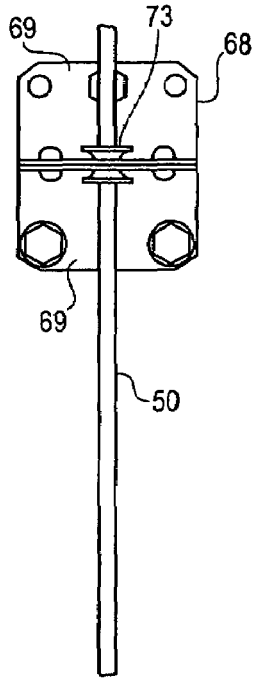

A first optional intermediate cable support 66 is intermediate stand off bracket 68 is shown in FIGS. 5A–5C. Standoff bracket 68 includes at least one vertical portion 69 that is used to connect intermediate standoff bracket 68 to horizontal panel 90 using bolts or other connections. In addition, intermediate standoff bracket 68 includes a horizontal portion 71 that further includes optional stiffeners 72 and that includes an aperture 73 that is large enough to accept cable 50. Aperture 73 shown in FIG. 5A–5C is a flared aperture. Aperture 73 is positioned on horizontal portion 71 of intermediate standoff bracket 68 in an location that allows cable 50 to pass through aperture 73 while under tension.

Figure 1B:
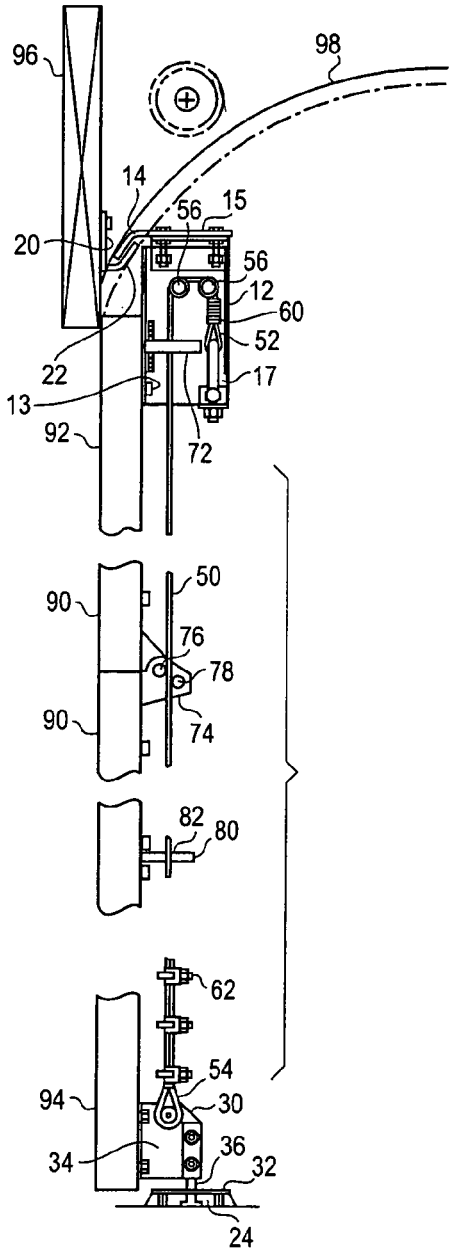
Figure 1C:
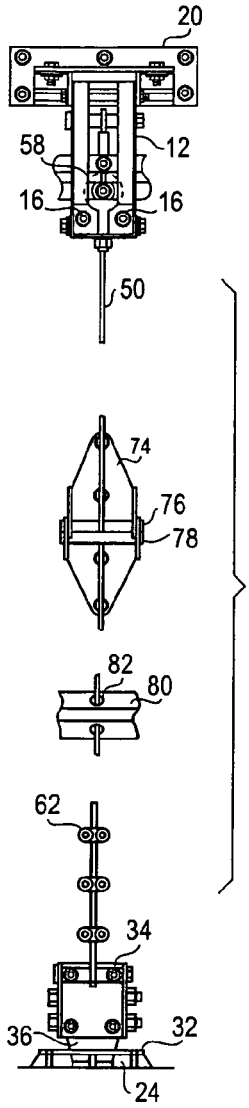
Figure 2A:
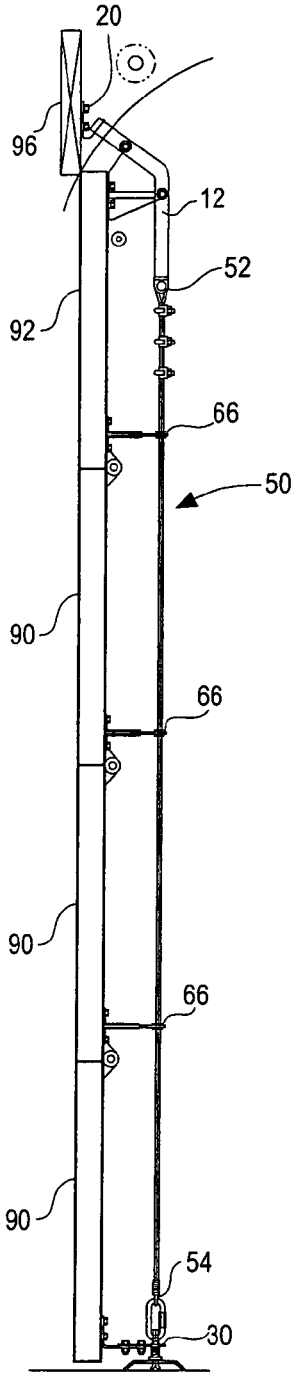
FIG. 2A is a side view of a cable system embodiment of this invention.
Figure 2B:
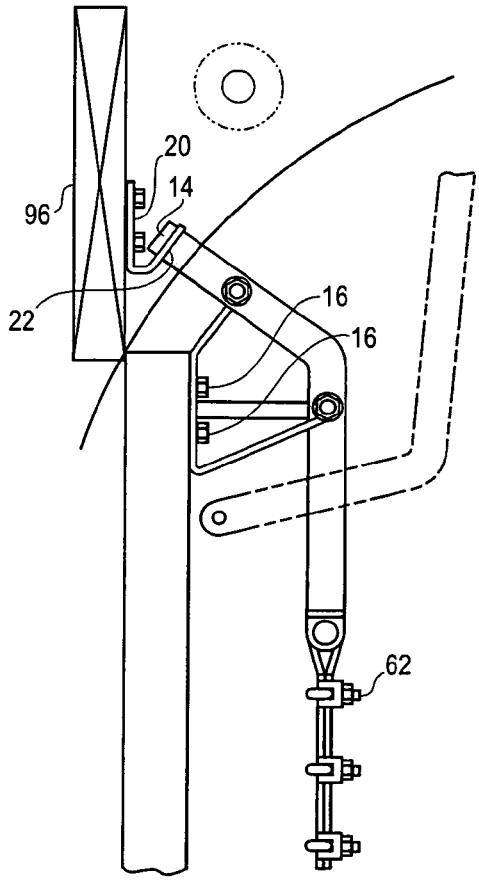
FIG. 2B is a side view of the upper bracket and header lock portion of the cable system embodiment of FIG. 2A.
Figure 2C:
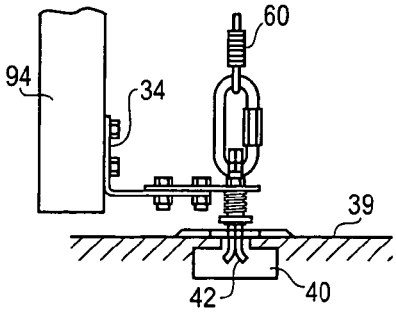
FIG. 2C is the a side view of the floor hook and floor plate portion of the cable system embodiment of FIG. 2A.
Figure 2D:
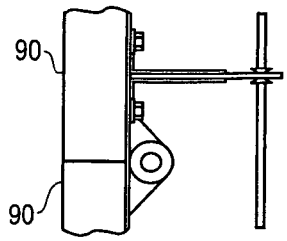
FIG. 2D is a side view of a standoff bracket of the cable system embodiment of FIG. 2A.

Intermediate cable supports 66 in the form of hinges 74 are shown in FIGS. 1A–1B. Hinges 74 includes a first pin 76 and a second pin 78. Pins 76 and 78 are offset laterally such that cable 50 can be directed between pins 76 and 78.

Another alternative intermediate cable support 66 is strut 80 also shown in FIGS. 1A–1B. Strut 80 is associated with horizontal panel 90 in a horizontal orientation. Strut 80 includes an aperture 82 that is large enough to accommodate cable 50. As with hinge 74, aperture 82 of strut 80 should be located in a position to allow cable 50 to pass through aperture 80 while under tension.

Figure 3A:
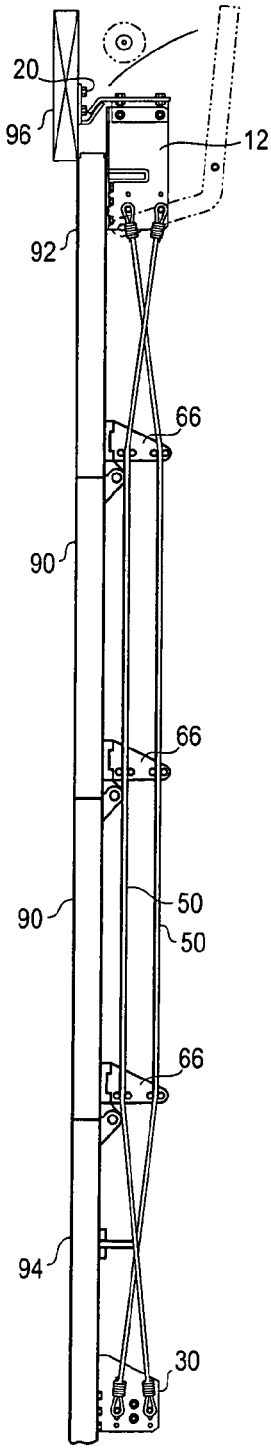
FIGS. 3A and 3B are side and front views respectively of a cable system embodiment of this invention.
Figure 3B:
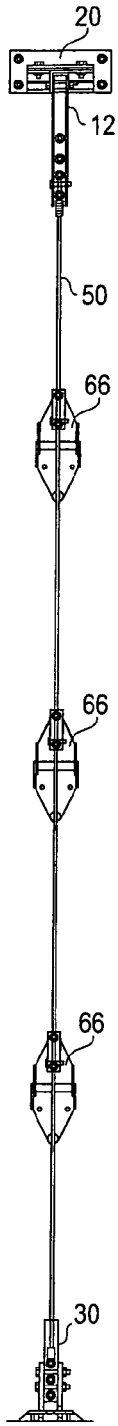
Figure 3C:
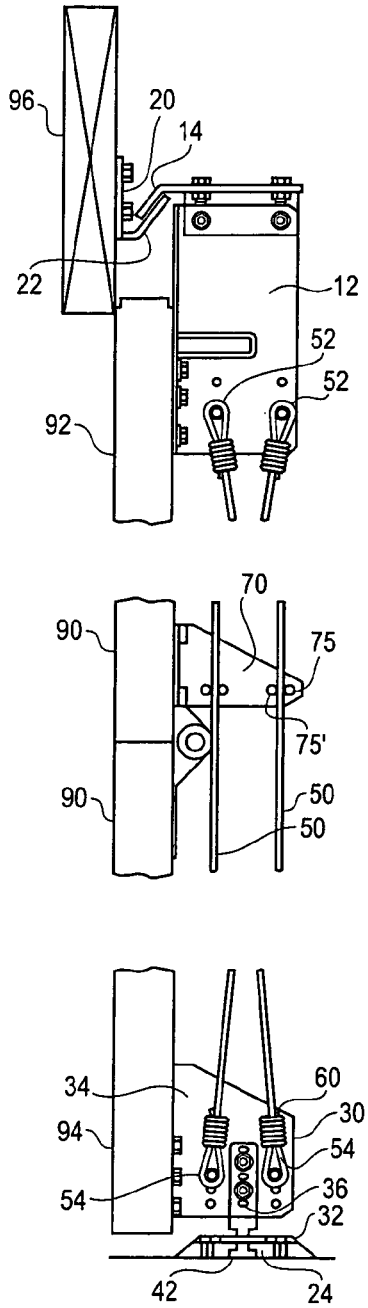
FIGS. 3C and 3D are close-up side and front views of elements of the cable systems embodiment of FIGS. 3A and 3B.
Figure 3D:
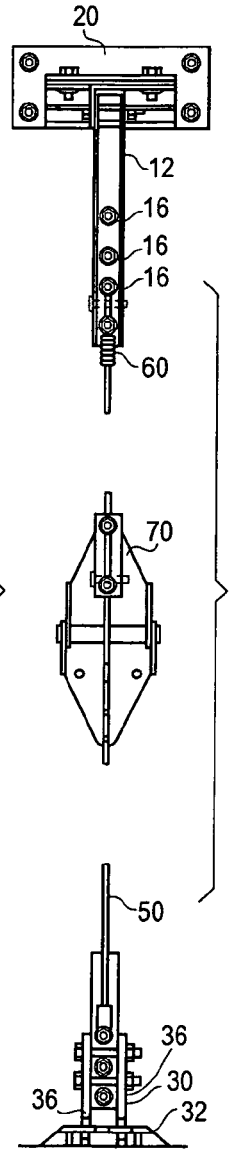

Yet another intermediate cable support embodiment is vertical standoff bracket 70 shown in FIGS. 3A–3B. Vertical standoff bracket 70 includes at least two pins 75 and 75' offset from one another in a horizontal direction by a distance sufficient to allow cable 50 to pass between pins 75 and 75'. Pins 75 and 75' do not need to be oriented on the same horizontal plane.

Cable system 10 of this invention may include an optional locking bracket 20. Locking bracket 20 is attached to header 96 which is located immediately above an overhead door. Header 96 is stationary and does not move with the overhead door. Locking bracket 20 includes a hook oriented outwardly from locking bracket 12. Hook 22 is complementary to optional hook 14 associated with header bracket 12. Hook 22 and hook 14 are orientated with one another such that hook 14 is located between hook 22 and header 96 when the overhead door is enclosed. Hook 22 and hook 14 become engaged when the overhead door is closed thereby preventing lateral movement of top panel 92 during high wind events. When the overhead doors open, hook 14 moves up and out of association with hook 22 thereby allowing the overhead door to completely open.

The cable systems of this invention are continuously associated with the overhead door. When the overhead door is closed, the steel cables run, under tension, from the floor hook through optional standoffs to the top header lock. When the door is in the closed position and positive or negative wind pressure is applied to the door panels the cables will be in a tension mode and resist any inward or outward movement of the door. Moreover, the locking mechanism associated with floor assembly 30 will prevent lateral movement of the bottom portion of the overhead door. Likewise, locking bracket 20 in association with header bracket 12 will prevent lateral movement of the proportion of the overhead door in high winds.

One cable system per overhead door may be sufficient to provide the necessary windload resistance. However, for further improvement to windload resistance, a cable system of this invention can be installed at each center and intermediate hinge location of the overhead door. The cable assembly adds very little weight to the door so costly re-springing is not required. No advance preparation for high winds is required. The cable systems may be supplied in kits for new or retrofit construction or they may accompany new overhead door installations.

What is claimed is:

1. A cable system for use with an overhead door comprising:

a header bracket;

a floor assembly;

at least one cable having a first end attached to the header bracket and a second end attached to the floor assembly, wherein the cable is held in tension between the header bracket and floor assembly and a plurality of hinges including a first pin and a second pin wherein the first pin and second pin are offset and where the at least one cable passes between the first pin and the second.

2. A cable system of claim 1 wherein a floor assembly includes a floor bracket including a hook and a floor plate wherein the hook is engageable with the floor plate.

3. A cable systems of claim 2 wherein the floor plate includes an aperature that engages the hook.

4. The cable system of claim 3 wherein the floor plate is flush with a floor and wherein the floor includes a hole essentially complementary to the floor plate aperture.

5. The cable system of claim 3 wherein the floor plate includes at least one spacer.

6. A cable systems of claim 1 including a plurality of cables, each cable having a first end attached to the header bracket and a second end attached to the floor assembly.

7. The cable system of claim 1 wherein the at least one cable is selected from a continuous length of cable or a non-continuous length of cable.

8. The cable system of claim 1 wherein the at least one cable is a non-continuous length of cable.

9. The cable system of claim 1 including a header bracket having a hook.

10. The cable system of claim 9 wherein the header bracket hook is complementary to a hook on a locking bracket.

11. The cable system of claim 2 wherein the hook includes a foot that fits into the floor plate aperture.

12. A cable system of claim 1 comprising a header bracket;

a floor assembly including a floor bracket having a hook and a floor plate including an aperture wherein the hook is engageable with the floor plate aperture;

at least one intermediate cable support selected from a hinge including a first pin and a second pin wherein the first pin and second pin are offset and where the at least one cable passes between the first pin and the second pin, and vertical standoff bracket including two offset pins where the at least one cable passes between the offset pins;

at least one cable having a first end attached to the header bracket and a second end attached to the floor assembly, wherein the cable is held in tension between the header bracket and floor assembly.

13. The cable system of claim 12 wherein the floor plate is flush with a floor and wherein the floor includes a hole essentially complementary to the floor plate aperture.

14. The cable system of claim 12 wherein the floor plate includes at least one spacer.

15. The cable system of claim 12 wherein the at least one cable is selected from a continuous length of cable or a non-continuous length of cable.

16. The cable system of claim 15 wherein the at least one cable is a non-continuous length of cable.

17. The cable system of claim 12 including a locking bracket.

18. The cable system of claim 17 wherein the header bracket includes a latch that is complementary to a latch of the locking bracket.

19. An overhead door comprising at least one cable system of claim 1 wherein the overhead door includes a plurality of horizontal panels including a top panel, a bottom panel and at least one intermediate panel, wherein the each of the plurality of hinges unite adjacent horizontal panels and wherein the header bracket is attached to the top panel and the floor assembly includes a floor bracket attached to the bottom panel.

20. The overhead door of claim 19 including a header having a header bracket with a hook.

21. The overhead door of 19 wherein the header bracket hook is complementary to a hook on the locking bracket.

22. The overhead door of claim 19 including two or more cable systems.

23. An overhead door comprising at least one cable system of claim 12 wherein the overhead door includes a plurality of horizontal panels including a top panel, a bottom panel and at least one intermediate cable support associated with at least one panel, wherein the header bracket is attached to the top panel and the floor assembly includes a floor bracket attached to the bottom panel.

24. The overhead door of claim 23 including a header having a header bracket with a hook.

25. The overhead door of 23 wherein the header bracket hook is complementary to a hook on a locking bracket.

26. The overhead door of claim 23 including two or more cable systems.

27. An overhead door including a plurality of horizontal panels including a top horizontal panel, a bottom horizontal panel and at least one intermediate horizontal panel;

a plurality of hinges each hinge including a first pin and a second pin wherein the first pin and second pin are offset and each hinge uniting adjacent horizontal panels; and a plurality of cable systems, each cable system including a header bracket, a floor assembly, at least one cable having a first end attached to the header bracket and a second end attached to the floor assembly wherein the cable is held in tension between the header bracket and floor assembly and where the at least one cable passes between the first pin and the second of each of the plurality of hinges of the cable system wherein a cable system is installed at a center hinge location and at an intermediate hinge location of the overhead door.

* * * * *